US006412138B1

(12) United States Patent
MacMillan

(10) Patent No.: US 6,412,138 B1
(45) Date of Patent: Jul. 2, 2002

(54) ADJUSTABLE LENGTH HANDLE FOR FLAT FINISHERS

(76) Inventor: Donald M. MacMillan, #12 23000 Dyke Rd., Richmond, B.C. (CA)

( * ) Notice: Subject to any disclaimer, the term of this patent is extended or adjusted under 35 U.S.C. 154(b) by 0 days.

(21) Appl. No.: 09/502,896

(22) Filed: Feb. 11, 2000

(51) Int. Cl.[7] ..... B25G 1/04

(52) U.S. Cl. ..... 15/144.2; 15/144.1; 15/144.4; 15/235.8; 16/429; 16/900

(58) Field of Search ..... 15/144.1–144.4, 15/235.8; 16/429, 900

(56) References Cited

U.S. PATENT DOCUMENTS 1,021,557 A * 3/1912 Runner ..... 15/235.8 X
5,088,147 A * 2/1992 MacMillan ..... 15/144.4
5,099,539 A * 3/1992 Forester ..... 15/144.3
6,260,238 B1 * 7/2001 MacMillan ..... 16/429

* cited by examiner

*Primary Examiner*—Mark Spisich
(74) *Attorney, Agent, or Firm*—Robert W. Jenny

(57) ABSTRACT

The primary structural parts of the handle are two telescopic tubes, the smaller diameter tube being an extrusion. A rib on the smaller tube engages a notch in a fitting attached to the larger tube to prevent relative rotation of the tube. A box footplate is attached to the free end of the larger tube with two degrees of angular freedom. The two axes of angular motion are perpendicular to each other and the axis of the handle. Angular motion of the box plate about one axis is transmitted by bevel gearing to telescopic torque transmission mechanism in the handle. Rotation of this mechanism and thereby the box plate about one axis is preventable by a lever operated clamp at the end of the handle. Rotation of the box plate about the other axis is manually adjustable. The length of the handle is manually adjustable and is set at a particular length by a lever operated length lock assembly.

1 Claim, 2 Drawing Sheets

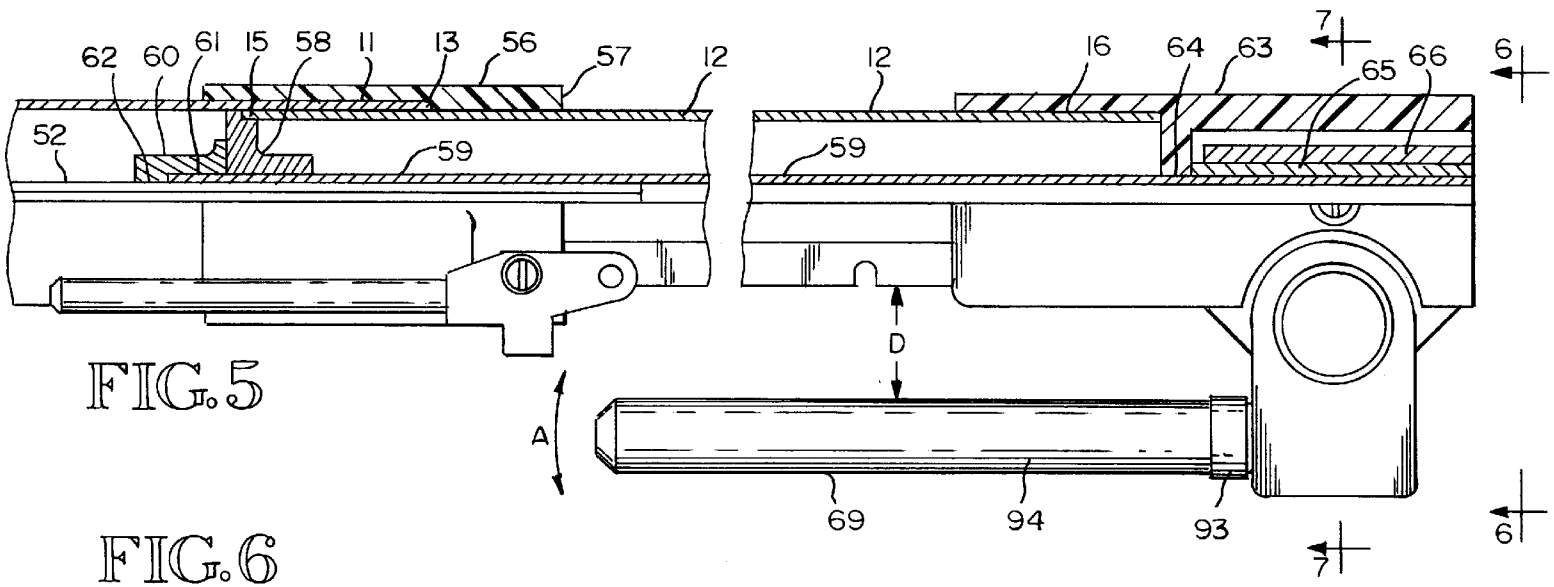
FIG. 5
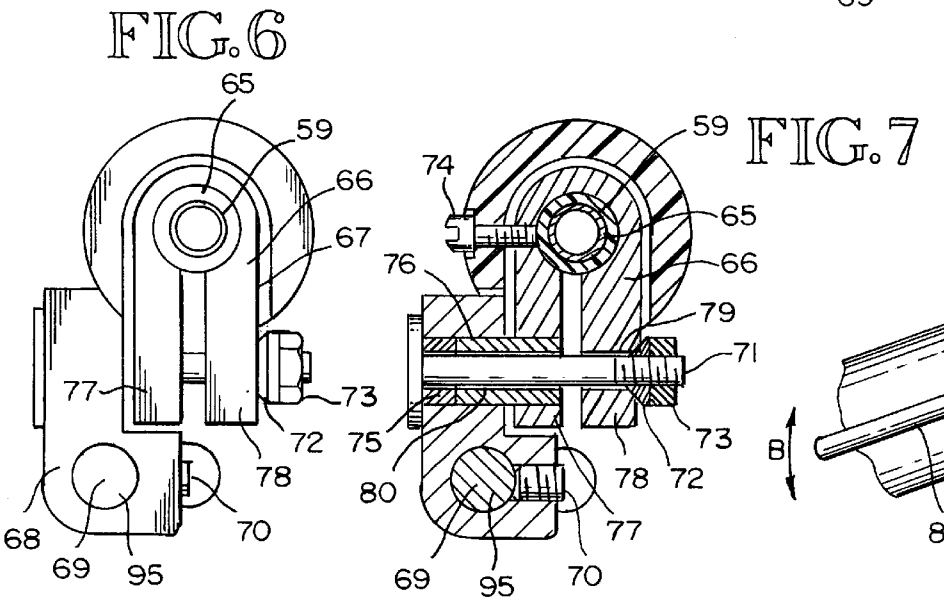
FIG. 6
FIG. 7
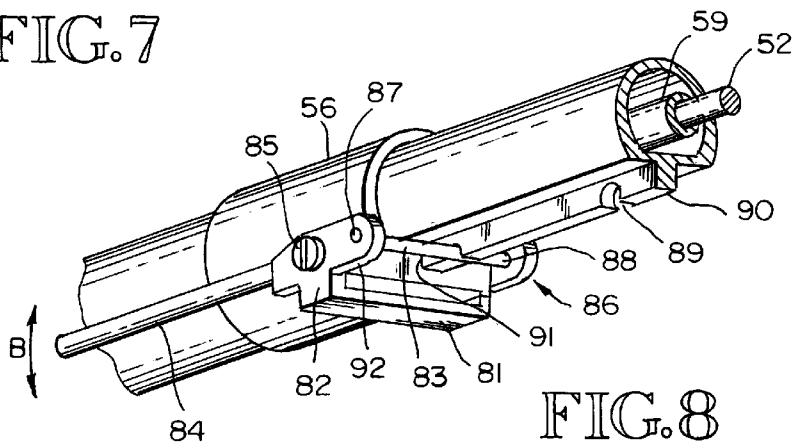
FIG. 8

ADJUSTABLE LENGTH HANDLE FOR FLAT FINISHERS

BACKGROUND OF THE INVENTION

1. Field

The subject invention is in the field of extendable/retractable apparatus such as tent poles, fishing rods and boat hooks which can be set at any length within a length range. More specifically it is in the field of such apparatus which incorporates mechanism by which one mechanism at one end of the apparatus operates and controls another mechanism at the other end of the apparatus. Still more specifically it is in the field of such apparatus and related mechanisms adapted for use with apparatus used in construction of dry walls in buildings, apparatus known in the trade as a flat finishing box, used in the crowning and finishing of taped joints between drywall panels.

2. Prior Art

Known prior art is shown in the patents listed below. These patents are:

U.S. Pat. No. 2,934,937

U.S. Pat. No. 3,105,262

U.S. Pat. No. 3,146,481

U.S. Pat. No. 3,090,984

U.S. Pat. No. 4,592,797

U.S. Pat. No. 5,088,147

U.S. Pat. No. 5,099,539

In the field of drywall construction and finishing, apparatus termed a flat finishing box is attached to a handle to enable the operator to apply the box to the joints being serviced by the box. To adapt the apparatus to various use situations various lengths of handles are needed to work with, for example, a variety of heights of ceilings and, also, the box must be set in a range of angles with respect to the long axis of the handle. The conventional apparatus comprises a fixed length handle with a lever at one end operable to lock the box pivoted at the other end of the handle at a specific angle to the handle axis. When a variety of lengths of handles is required, it is necessary either to have a number of flat finishing boxes, each attached to a specific length handle or to use fewer boxes than handle lengths required, (usually one box) and interchange the box or boxes from handle to handle in order to have the box on a handle of suitable length. The use of multiple boxes, each with a different length handle attached, is not generally acceptable because of the cost and because the compound used in the boxes sets up, i.e. hardens, so that compound in boxes not fully emptied in use is wasted and removal of the wasted compound is time consuming. The use of fewer boxes than handles is standard practice but changing the boxes from handle to handle is time consuming and tends to be awkward if the box contains the compound referred to in the trade as "mud".

Therefore, for flat finishing drywall joints more efficiently in terms of the interrelated factors of time and cost, there has been a need for a flat finishing tool with an adjustable length handle, particularly one adjustable to specific lengths in a range of lengths.

U.S. Pat. No. 5,099,539 (Forrester) and U.S. Pat. No. 5,088,147 (MacMillan, the inventor of the subject invention) and U.S. patent application, Ser. No. 09/414,677, U.S. Pat. No. 6,260,238, also by MacMillan all show adjustable length handles for flat finishers. All of these handles have a lever pivoted at one end and a part called a box footplate pivoted at the other. In use a flat finishing box is attached to the footplate, the handle is adjusted to the needed length, and the handle is maneuvered to place the box against the work surface. This placement sets the box and footplate at an angle to the long axis of the handle and the lever is operated to lock the box and footplate at that angle relative to the handle. The mechanical complexity of these prior art adjustable length handles for flat finishers is typical in the prior art and increases first and maintenance costs of the handles and degrades their reliability, thereby increasing operation costs. The lock mechanism in particular tends to be delicate relative to its performance requirements and the range of angular motion of the box footplate is quite limited. The handle of U.S. patent application, Ser. No. 09/414,677, U.S. Pat. No. 6,260,238 is considered to be the least complicated and most rugged of the three prior art handles. Nevertheless, there is a continued need for more ruggedness. Also, there is a newly recognized need for two degrees of freedom of angular adjustment of the footplate (and attached box) relative to the handle.

Accordingly, the primary objective of the subject invention is to provide a less complicated adjustable length handle for flat finishers because of the significant savings in costs that the reduced complication facilitates. Other objectives are that the range of angular motion of the box footplate be relatively large, that there be two degrees of freedom of angular adjustment of the box footplate relative to the handle, that there be no highly loaded small parts, that the handle be relatively lightweight and that it be ergonomically acceptable.

SUMMARY OF THE INVENTION

The subject invention is an adjustable length handle for flat finishers. The primary structural components of the handle are two telescopic tubes. Relative rotation of the engaged tubes is prevented by engagement of a longitudinal rib on the outside of one tube with a groove in a fitting on the other tube. When the tubes are telescopically engaged each has an overlapped end and a free end. A fitting termed a box footplate is pivotally attached to the free end of the larger, outer tube, with two orthogonal pivot axes perpendicular to the long axis of the tubes. A first pivot of the box plate is a shaft running in bearings in a second fitting. A bevel gear on this pivot shaft for the box plate engages a second bevel gear which is mounted on a second shaft which extends through a fitting assembly which pivotally connects the second fitting and box plate to the free end of the larger tube. This second pivot connection provides a second degree of angular freedom of the box footplate relative to the axis of the handle. The axis of this second pivot connection is perpendicular to the axis of the pivot shaft for the box plate and to the axis of the handle. The fitting assembly is pivoted in a fixture assembly which is attached to the free end of the larger tube and includes a universal joint which connects the second shaft, through the fitting assembly, to a hex shaft assembly which is journalled in the larger tube with its axis coincident with the handle axis. The intersection of the axes of the universal point lies in the axis of the second pivot connection. The angular adjustment about the second pivot axis is manually made and locked in one of three positions. The primary component of the shaft assembly is a hexagonal rod which engages a hexagonal hole in a fitting attached to a torque assembly journalled in the smaller diameter tube and extending the full length of that tube. The hexagonal tube in the hexagonal hole causes the rotation of the torque tube to be the same as the rotation of the hex rod. As the larger and smaller handle tubes are telescopically adjusted to adjust handle length, the hex rod telescopes in the tube of the torque tube assembly.

A bushing, part of the torque tube assembly, is installed on the end of the torque tube in a rear fitting attached to the free end of the smaller tube. The bushing is engaged by a lever operated clamp, the clamp and lever being mounted in rear fitting. Operation of the lever engages the clamp on the bushing, preventing rotation of the torque tube assembly, the hex shaft assembly, the universal joint and thereby the angular movement of the box plate relative to the handle about the first pivot connection.

The invention is described in more detail below with reference to the attached drawings.

BRIEF DESCRIPTION OF THE DRAWINGS

FIG. 5 is a partial section of the subject handle, taken at 5—5 in FIG. 1 and further foreshortened.

FIG. 6 is an end view of the handle, taken at 6—6 in FIG. 5.

FIG. 7 is a section taken at 7—7 in FIG. 5.

FIG. 8 is a view of the length lock assembly taken from below and to one side of the handle.

DETAILED DESCRIPTION OF THE INVENTION

Figures 1, 2, 3, 4:
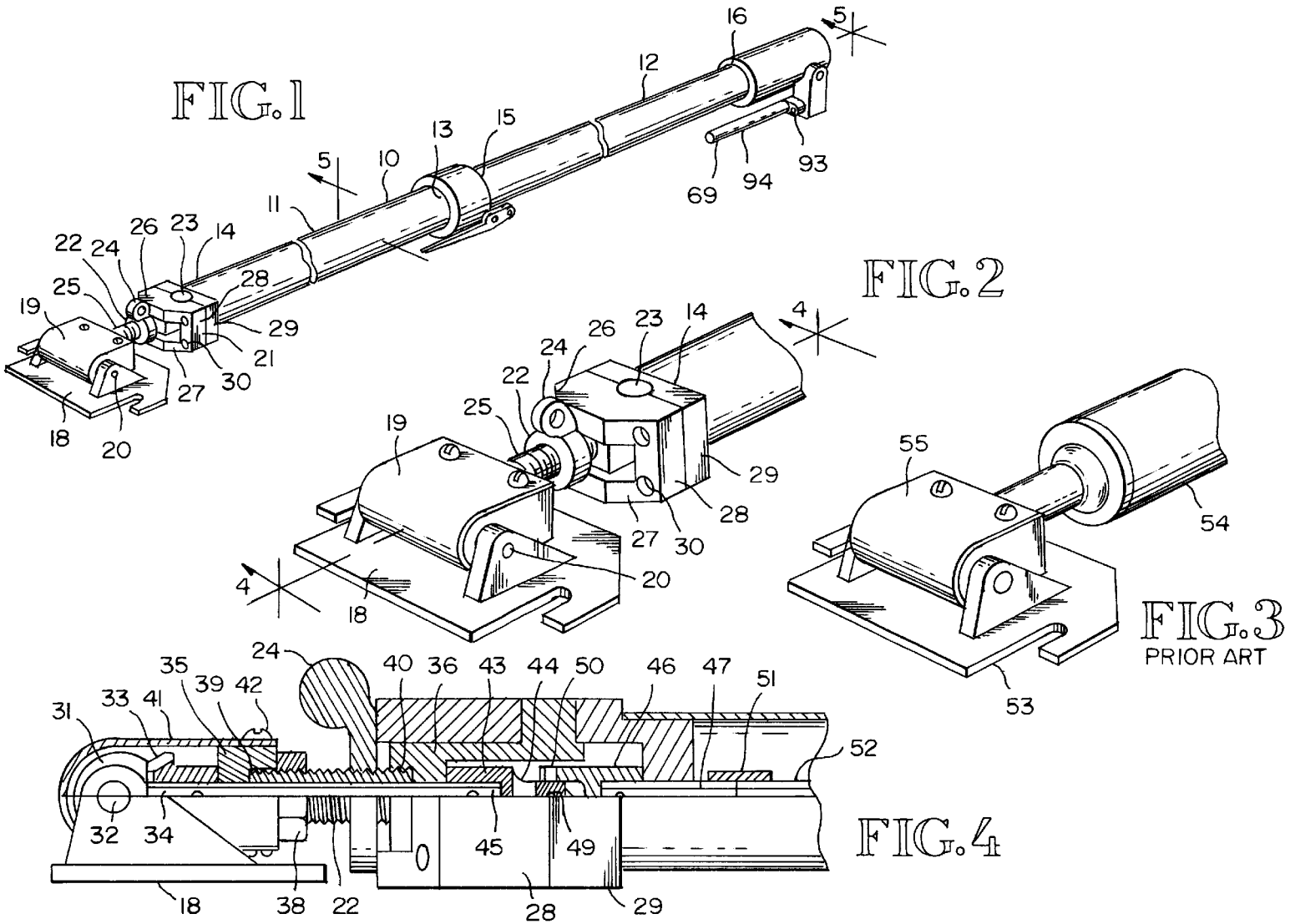
FIG. 3 PRIOR ART
FIG. 1 is a general view of one embodiment of the subject handle, foreshortened.
FIG. 2 is an enlarged view of the box plate end of the handle.
FIG. 3 is the box plate end of the handle disclosed in U.S. patent application, Ser. No. 09/414,677, filed Oct. 7, 1999, U.S. Pat. No. 6,260,238, by the inventor of the subject invention.
FIG. 4 is a partially sectioned view of the box plate end of the handle taken at 4—4 FIG. 2.

The subject invention is an adjustable length handle for flat finishers, one embodiment 10 being shown in FIG. 1. The primary parts of the handle are telescopic tubes 11 and 12, tube 11 having the larger diameter, an overlapping end 13 and a free end 14. Tube 12 is an extrusion having a specialized cross section shape described below, and overlapping end 15 and a free end 16.

Box plate assembly 17 is attached to end 14 of tube 11. Box plate 18 is pivotally attached to gear box 19 at 20. The gear box is attached to swivel assembly 21 by fitting assembly 22. Fitting assembly 22 is pivotally attached in the swivel assembly at 23. The axes of pivotal attachments at 20 and at 23 are perpendicular to each other and to the longitudinal axis of the handle, giving the box plate 18 two degrees of angular freedom relative to the coincident axes of the tubes of the handle. The box plate assembly can be set at 3 angles relative to the swivel assembly by loosening a thumb nut 24, threadably engaged on tube 25 of the fitting assembly, moving the assembly to one side or the other and tightening the thumb nut against face 26 or 27 of the cover 28 of the swivel assembly. Cover 28 is attached to base 29 of the swivel assembly by threaded fasteners, fastener 30 being typical. It is shown in the center, in line setting in FIG. 1. It can be swiveled in either of two directions about pivot 23.

FIG. 2 is an enlarged view of a portion of FIG. 1 with corresponding part numbers.

FIG. 4 is a partial section of the box plate end of the handle, taken at 4—4 in FIG. 2. Bevel gear 31 in the gearbox is attached to shaft 32 which is attached to the box plate 18. Bevel gear 33 engages gear 31 and is attached to shaft 34 which is journalled in gearbox base 35 and yoke 36. The gearbox base and the yoke are interconnected by fitting assembly 22 which comprises tube 25, lock nut 38 and thumbnut 24. End 39 of tube 25 is threaded into base 35 and end 40 of tube 25 is threaded into yoke 36. Nut 38 secures the attachment of the tube to the gearbox base. The tube is threaded securely into the yoke and nut 38 enables desired alignment of the box plate with the rest of the handle. Thumbnut 24 functions as described above. Gearbox cover 41 is attached to the base by threaded fasteners, fastener 42 being typical.

Part 43 of universal joint 44 is attached to end 45 of the shaft 34 and part 46 of the universal joint is attached to stub shaft 47 which is journalled to swivel assembly base 29. Swivel assembly cap 28 is attached to base 29 by threaded fasteners, fastener 30 being typical. The axis of the pivotal connection of the yoke in the swivel assembly is coincident with the axes of the connections of the universal joint parts at pins 49 and 50. Stub shaft 47 is attached by fitting 51 to hex rod 52 which has a hexagonal cross section shape.

FIG. 3 is the box plate end of the handle disclosed in U.S. patent application, Ser. No. 09/414,677, filed Oct. 7, 1999, U.S. Pat. No. 6,260,238, by the inventor of the subject invention. This box plate end can be used to form an alternate embodiment of the subject invention and provides one degree of angular freedom of box plate 53 relative to handle 54. Bevel gearing in gearbox 55 connects the box plate to a shaft which is connected to the hex rod in place of stub shaft 47.

FIG. 5 is a foreshortened partial section taken at 5—5 in FIG. 1. Fitting 56 is attached to free end 13 of tube 11. Tube 12 fits through end 57 of the fitting and telescopes into and out of tube 11. Fitting 58 is attached to end 15 of tube 12 and serves as a journal for tube 59. Fitting 60 is attached to end 61 of tube 59 and has a hexagonally shaped hole 62 which engages rod 52, whereby rod 52 and tube 59 are rotatably connected. As tubes 11 and 12 are telescopically adjusted, rod 52 extends into and out of tube 59. Fitting 63 is attached to end 16 of tube 12 and tube 59 is journalled at 64 in fitting 63. Bushing 65 is attached to tube 59 and engaged by clamp 66 of clamp assembly 67 shown in FIGS. 6 and 7.

FIG. 6 is an end view of the handle taken at 6—6 in FIG. 5 and FIG. 7 is a section taken at 7—7 in FIG. 5. Clamp assembly 67 comprises clamp 66, handle base 68, handle 69, set screw 70, clamp bolt 71, washer 72, nut 73, lock screw 74, base cam 75 and clamp cam 76. Cam 75 is press fitted into base 68. Cam 76 is press fitted into leg 77 of clamp 66. In operation, when handle 69 is moved in the direction indicated by arrow A in FIG. 5, cams 75 and 76 interact to pull legs 77 and 78 of clamp 66 together, clamping up on bushing 65 to prevent tube 59 from rotating and thus, because of parts interconnections previously explained, preventing angular motion of the box plate about pivot axis 20. When handle 69 is released it returns to the position shown as cams 75 and 76 come into full contact. Nut 73 is adjusted to bring the cams into full contact while leaving the clamp loose on bushing 65. Spherical faced washer 72 and clearances 79 and 80 accommodate the minor misalignments caused by the relative motion of legs 77 and 78. Screw 74 prevents rotation of the clamp assembly relative to the rest of the handle.

All of the components used in transmitting rotation and thereby torque from the box plate to the clamp are termed "rotation transmission components". These components include the bevel gears in the box plate assembly and a universal joint in the swivel assembly.

FIG. 8 is a view taken from below and to one side of the length lock lever assembly 81. Lever assembly 81 comprises rocker 82, pin 83 and lever 84. Rocker 82 is pivoted on fitting 56 by screws 85 and 86 (not visible in this view). Pin 83 is carried in holes 87 and 88 and engages one of a plurality of notches, notch 89 being typical, in rib 90 of tube 12. Rib 90 engages notch 91 in fitting 56, preventing relative rotation of the two tubes. Coil torsion spring 92 urges engagement of pin 83 into the notches in the rib. To change length of the handle, lever 84 is moved in the direction indicated by arrow B to disengage the pin. The tubes are then adjusted to provide the desired handle length and moved to allow engagement of the pin in the closest available notch. Hex rod 52 is shown extending through torque tube 59. Handle 69 has a crank arm 93 (FIG. 5) so that portion 94 of the handle is centered under the tubes while portion 95 (FIGS. 5, 6, and 7) is engaged as shown in base 68. This configuration enables the distance D between tube 12 and portion 94 to be adjusted by loosening set screw 70, rotating the handle to put portion 94 at a desired distance D and then re-tightening the set screw.

It is also considered to be understood that while certain embodiments of the invention are disclosed, other embodiments and modification so those disclosed are possible within the scope of the invention which is limited only by the attached claims.

I claim:

1. An adjustable length handle for flat finishers, said handle comprising first and second telescopic tubes, said first tube being larger in diameter than said second tube, each of said tubes having an overlapped end and a free end, said handle further comprising a box plate, a box plate assembly and a swivel assembly, said box plate being pivotally attached to said box plate assembly by a first pivotal attachment, said box plate assembly being attached to said swivel assembly by a second pivotal attachment, said swivel assembly being attached to said free end of said first tube, said first and second pivotal attachments providing two degrees of angular freedom between said box plate assembly and said tubes, said handle further comprising bevel gears in said box plate assembly, a universal joint in said swivel assembly and telescopic rotation transmission components in said tubes for transmitting said rotation to said free end of said second tube, said handle further comprising lever operated clamping means attached to said free end of said second tube, said clamping means engaging one of said torque transmission components such that operation of said lever operated clamping means prevents rotation of said rotation transmission components and rotation of said box plate about said first pivotal attachment in said box plate assembly.

* * * * *

Disclaimer and Dedication

6,412,138 B1—Donald M. MacMillan, Richmond (CA). ADJUSTABLE LENGTH HANDLE FOR FLAT FINISHERS. Patent dated July 2, 2002. Disclaimer filed May 3, 2010, by the inventor.

Hereby enters this disclaimer to the claim and the entire term remaining on said patent and dedicate the same to the public.

(*Official Gazette, June 15, 2010*)